US008123592B2

(12) United States Patent
D'Alessandro et al.

(10) Patent No.: US 8,123,592 B2
(45) Date of Patent: Feb. 28, 2012

(54) HEATLESS SLURRY SYSTEM

(75) Inventors: Idolo D'Alessandro, St-Léonard (CA); Domenic D'Alessandro, St-Léonard (CA)

(73) Assignee: Sauvé Vitres Inc., Saint-Léonard (CA)

( * ) Notice: Subject to any disclaimer, the term of this patent is extended or adjusted under 35 U.S.C. 154(b) by 700 days.

(21) Appl. No.: 12/263,758

(22) Filed: Nov. 3, 2008

(65) Prior Publication Data

US 2009/0117834 A1 May 7, 2009

Related U.S. Application Data

(60) Provisional application No. 60/984,867, filed on Nov. 2, 2007.

(51) Int. Cl.
*B24B 49/00* (2006.01)

(52) U.S. Cl. ..... 451/7; 451/99

(58) Field of Classification Search ..... 451/7, 99, 451/446

See application file for complete search history.

(56) References Cited

U.S. PATENT DOCUMENTS

| | | | | |
|---|---|---|---|---|
| 2,576,008 | A * | 11/1951 | Gladfelter et al. | 451/89 |
| 3,028,711 | A | 4/1962 | Campbell | |
| 3,584,841 | A * | 6/1971 | Field | 366/134 |
| 4,513,894 | A | 4/1985 | Doyle et al. | |
| 4,622,780 | A * | 11/1986 | Tingley | 451/41 |
| 4,709,513 | A * | 12/1987 | Tingley | 451/41 |
| 5,827,114 | A | 10/1998 | Yam et al. | |
| 6,156,659 | A | 12/2000 | Roy | |
| 6,306,020 | B1 | 10/2001 | Hed et al. | |
| 6,402,599 | B1 | 6/2002 | Crevasse et al. | |
| 6,672,940 | B1 * | 1/2004 | Graham | 451/7 |

FOREIGN PATENT DOCUMENTS

CA 1258772 8/1989

* cited by examiner

*Primary Examiner* — Maurina Rachuba

(74) *Attorney, Agent, or Firm* — Goudreau Gage Dubuc Gonzalo Lavin

(57) ABSTRACT

A heatless slurry system for use with a glass removal apparatus for restoring a glass surface. The system comprises a slurry container and a pump mounted externally relative to the container to prevent heating of the slurry as the system is operated. Vacuum pressure is created by activation of the pump to promote circulation of the slurry within the tool, thereby allowing the latter to be worked against the surface.

20 Claims, 6 Drawing Sheets

HEATLESS SLURRY SYSTEM

CROSS REFERENCE TO RELATED APPLICATIONS

This application claims priority on U.S. Provisional Application No. 60/984,867, filed on Nov. 2, 2007 and which is herein incorporated by reference in its entirety.

FIELD OF THE INVENTION

The present invention relates to a heatless slurry system. More specifically, the present invention is concerned with a slurry system for restoring a surface such as glass.

BACKGROUND OF THE INVENTION

Glass restoration systems are used to remove scratches, mineral deposits or other stains from a valuable piece of glass to save the cost of replacing it. The main components of a known glass restoration system are a pump, a tool for polishing or fining, a water supply tank, hoses, and a slurry container. The container contains the slurry, a mixture of minerals and water forming an abrasive polishing solution. Hoses run from the container to the tool, comprised of a drill to which is attached a polishing or fining pad or disc. Also connected to the hoses, there is a submersible pump placed inside the container for recirculation of the slurry. The slurry goes from the pump through the tool, onto the disc and working surface interface and back into the container before being pumped again. When the pump operates, a vacuum is created between the tool and the working surface.

With the above known glass restoration system, the flow of slurry cools the working surface and allows a faster rotation of the tool, resulting in a rapid completion of the work. However, this known glass restoration system causes a considerable heat of the slurry. Indeed, the heat created by the working pump located inside the slurry container is transferred directly to the re-circulated slurry thereby overheating it. When the slurry reaches a certain temperature, chemical reactions with catalysts within the slurry slow down and the slurry thus loses its ability to remove scratches by over 50% and has to be replaced. The work must be interrupted for a considerable period of time since the slurry has to be pre-mixed by hand in the container before starting back the pump.

Furthermore, if the slurry is used beyond a certain temperature, the tool shroud melts and the polishing or fining disc or pad becomes warped. Since this known glass restoration system heats the slurry considerably, the user needs to be constantly aware of the slurry temperature to avoid damage to the tool. For example, the user typically needs to stop working to wait for the slurry compound and the tool to cool down, thus leading to wasted time.

In order to overcome heat problems associated conventional slurry systems, the prior art teaches the use of systems for cooling the slurry compound as it circulates through the grinding/polishing system. Such a cooling system typically includes a cooling module, such as a refrigeration unit, connected to a heat-transfer device. In operation, the cooling module cools the heat-transfer device, which in turn cools the slurry compound. However, such cooling systems are typically used to overcome heat generated by the various sources within the slurry system and, as such, the pump itself has not been identified as the major source of heat to be overcome.

Consequently, there exists a need for a slurry recirculation system linked to the tool, used for polishing or fining or the like, that does not overheat the abrasive polishing solution or slurry and allows continuous use of the polishing tool.

SUMMARY OF THE INVENTION

According to the present invention, there is provided a heatless slurry system for restoring a surface comprising a container containing an abrasive slurry solution; a tool adapted to be moved across the surface for restoration thereof, the tool comprising a housing having mounted thereto a first connection line in fluid communication with the container for drawing the abrasive slurry solution into the housing and a second connection line for removing the drawn abrasive slurry solution from the housing; and a pump comprising an inlet and an outlet connected to the container for providing fluid communication therewith. The outlet comprises a pressurized vessel for creating a vacuum pressure as the abrasive slurry solution is pumped from the container through the inlet and expelled through the outlet. The pressurized vessel is connected to the second connection line. The vacuum pressure draws the abrasive slurry solution into the housing via the first connection line and subsequently removes the drawn abrasive slurry solution from the housing via the second connection line, thereby creating a flow of the abrasive slurry solution within the housing for restoring the surface. A surface of the pump is removed from the abrasive slurry solution for thermally isolating the pump therefrom, thereby preventing a rise in a temperature of the abrasive slurry solution as a result of operation of the pump.

DESCRIPTION OF ILLUSTRATIVE EMBODIMENTS

The present invention is illustrated in further details by the following non-limiting examples.

Figure 1:
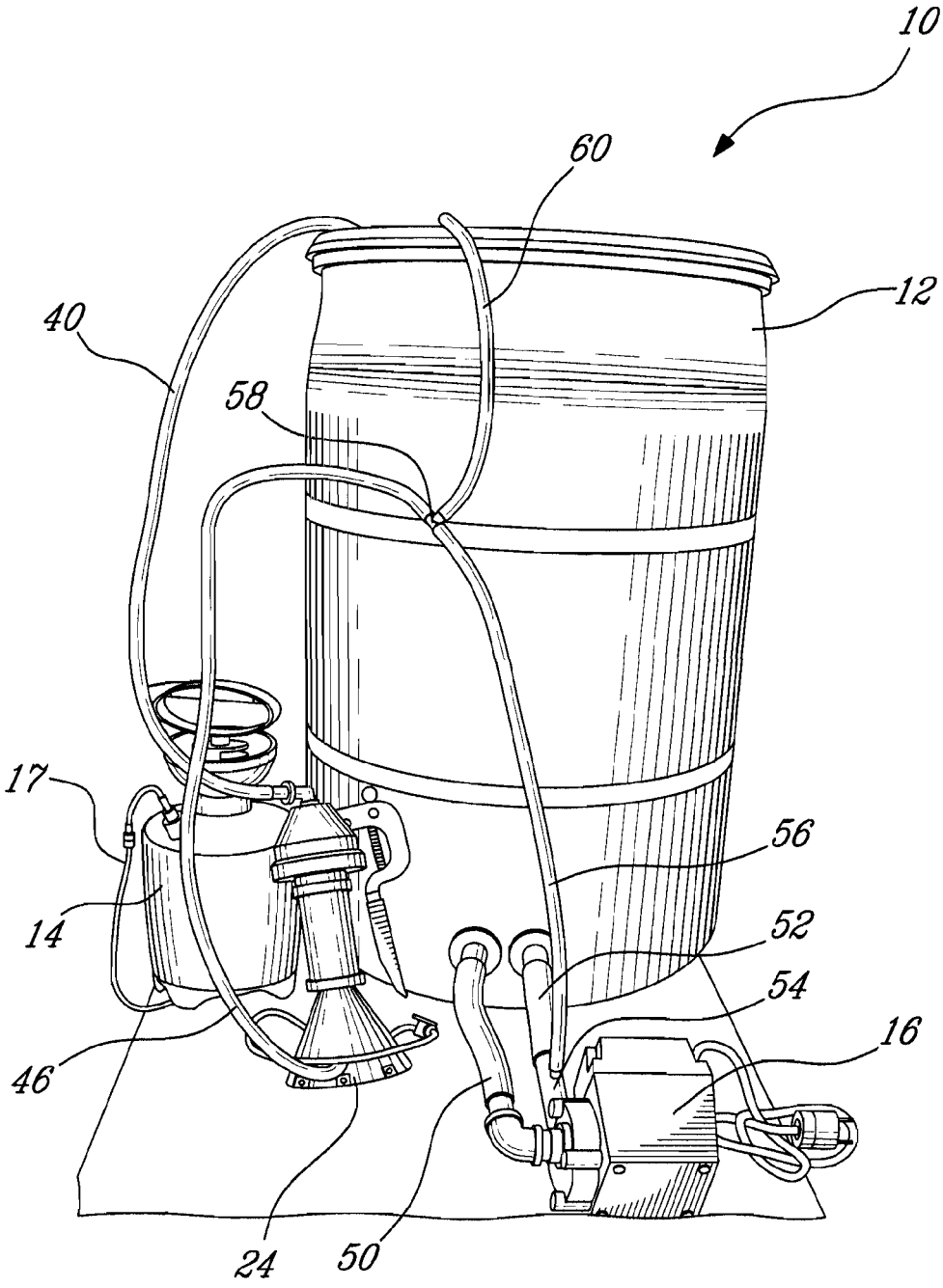
FIG. 1 is a perspective view of a heatless slurry system in accordance with an illustrative embodiment of the present invention.

Referring now to FIG. 1, a heatless slurry system, generally referred to using the reference numeral 10, will now be described. The heatless slurry system 10 includes a slurry container 12 containing an abrasive slurry solution, a polishing tool 24 and a pump 16 illustratively positioned externally with respect to the container 12. As it will be apparent to those skilled in the art, the polishing tool 24 may be replaced by a fining tool or other similar tools for restoring a surface. A separate water tank 14 may be used as it will be explained further herein below. The pump 16 creates a vacuum effect that eases the displacement of the polishing tool 24 on a surface (e.g. glass 26 or the like, shown in FIG. 4) to be restored while also enabling the abrasive solution to be extracted from the container 12 into the tool 24 for restoring the surface. In particular, scratches, stains, deposits, splatters, spots caused by acid rains, and other alterations (e.g. as much as 0.001 inch deep and about two (2) inches wide) of the surface to be restored may be fixed using the system 10. The purpose of the water tank 14 is to ease the displacement of the tool on the surface to be restored. Indeed, in use, water is directly brought by a hose 17 from the water tank 14 to the tool 24 and used as a lubrication means between the tool 24 and the surface to restore.

Figure 2:
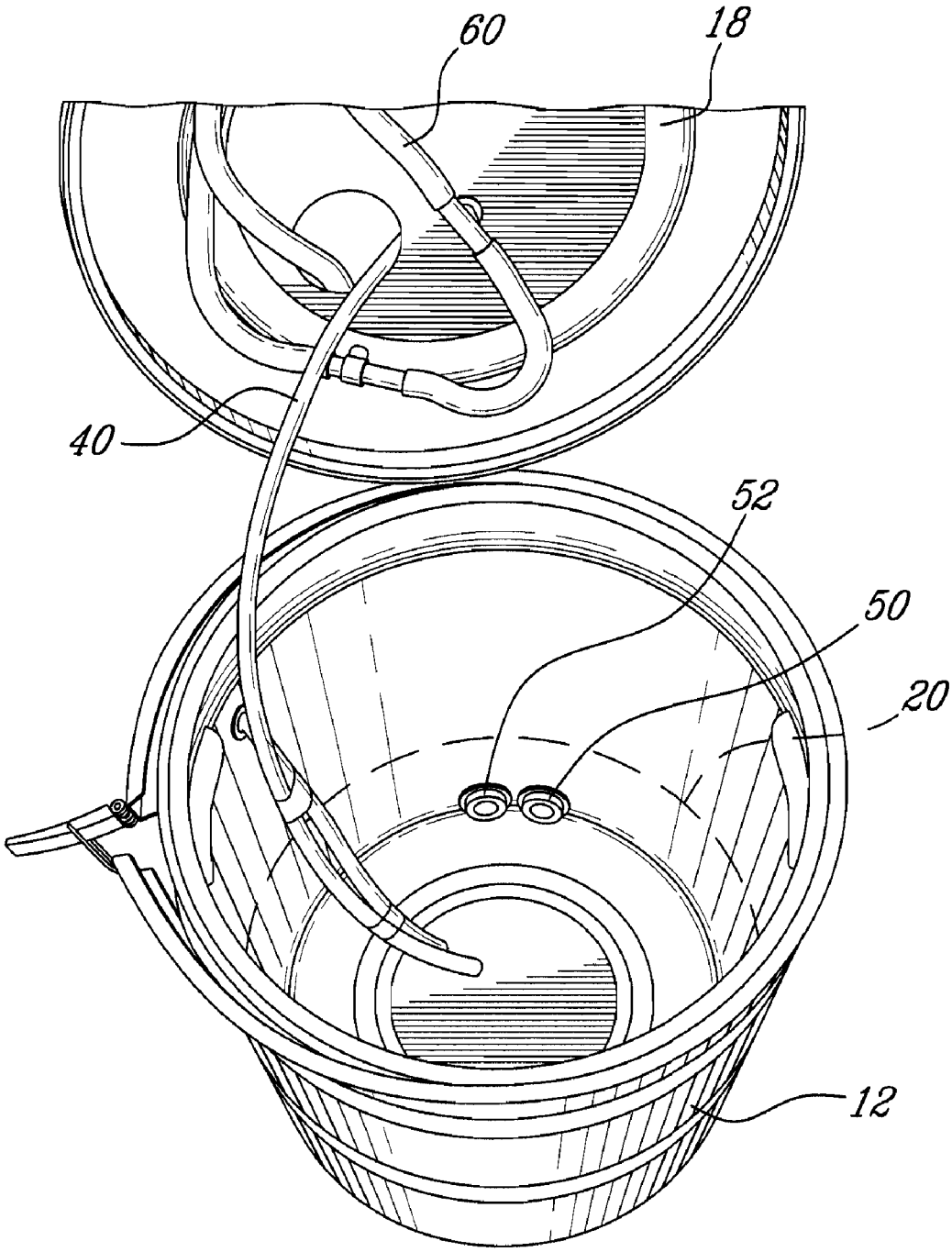
FIG. 2 is a top perspective view of an opened slurry container of the heatless slurry system of FIG. 1.
Figure 3:
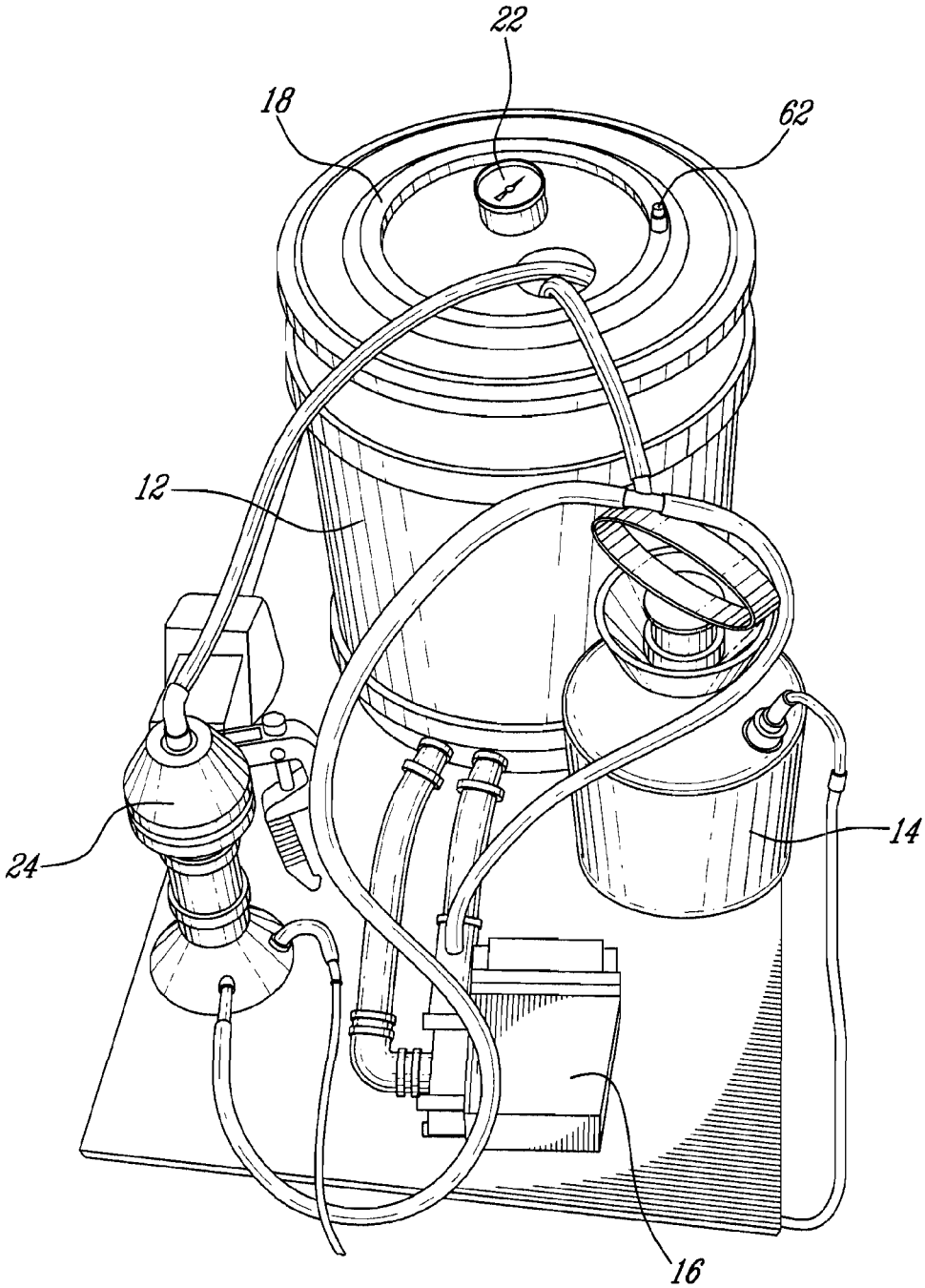
FIG. 3 is a top perspective view of a slurry container of the heatless slurry system of FIG. 1.

Referring now to FIG. 2 and FIG. 3, the slurry container 12 is closed by a lid 18 and illustratively contains slurry supply liquid 20 containing abrasive or rubbing compound particles, solids or the like (not shown), in suspension, which act as catalysts that chemically react with the surface to restore in order to make ease treatment thereof and thus achieve the desired abrasive effect. A vacuum gauge 22 may be mounted to the container lid 18 to serve as an indicator of the good functioning of the pump (reference 16 in FIG. 1) by measuring the vacuum pressure created in the heatless slurry system, as discussed in further detail herein below. A vacuum bleed valve 62 may also be attached to the container lid 18 to adjust the amount of vacuum circulation within the system 10.

Figure 4:
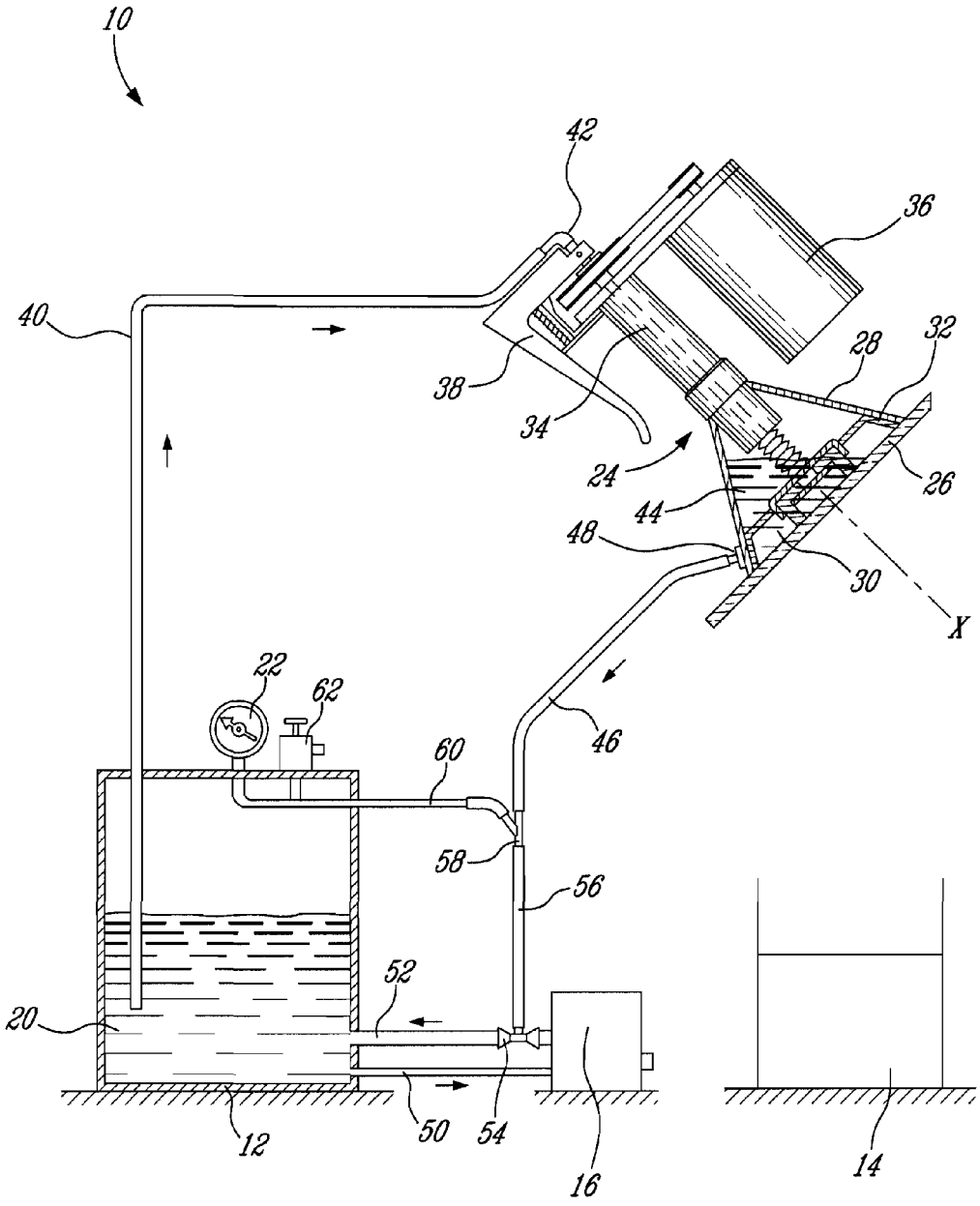
FIG. 4 is a sectional, part schematic view of the heatless slurry system of FIG. 1.

Referring now to FIG. 4, in operation, the heatless slurry system 10 is used in conjunction with a tool 24, which can either be arranged for a polishing, fining and/or grinding step (with a grinding tool 24 shown in FIG. 4 for illustrative purposes) with the arrangements described herein above being the same for tools as in 24 used in both operations. The tool 24 is illustratively supported on the surface of a plane of glass 26, which for example has a scratch (not shown) to be removed. Such a tool 24 comprises a generally conically-shaped housing or shroud 28 made of semi-flexible plastic, such as ABS plastic. A grinding pad (or fining disc) 30 is mounted within the housing 28 such that a lower edge thereof defines a plane that is substantially flush with the surface of the glass 26 to be repaired, thus ensuring proper operation of the polishing pad 30. A seal 32 is further provided around the perimeter of the housing 28 to seal the latter against the surface of glass 26 being worked on. A housing tube 34 is also connected to the shroud 28 and supports a drive shaft (not shown) for driving the polishing pad 30. A motor support plate (not shown) is mounted to the upper end of the housing tube 34 for supporting a high speed electric motor 36 (e.g. 120 volt AC, 6000-7000 rpm) spaced laterally from the housing tube 34. A retraction lever 38 is pivotally attached to the support plate, such that when the lever 38 is pivoted by causing an arm section (not shown) thereof to move towards the housing tube 34, the polishing pad 30 is urged downwardly towards the surface of the glass 26 through the use of a spring assembly (not shown).

Still referring to FIG. 4, in order to carry out the grinding (or alternatively the fining or polishing) operation, the pump 16 illustratively does not itself supply the tool 24 with slurry 20 but rather creates a vacuum effect that promotes slurry circulation. For this purpose, a slurry intake tube 40 is connected to the polishing tool 24 through an adapter (e.g. a rotary fitting) 42 to draw the slurry 20 from the slurry container 12 up to the tool 24 using vacuum pressure created by the pump 16, as discussed in further detail herein below, and circulate the drawn slurry 44 through the tool 24. For this purpose, a vacuum and draw tube 46 is mounted through a fitting 48 to a lower portion of the housing 28 adjacent the glass surface 26. The vacuum and draw tube 46 pulls from the tool 24 part of the slurry 44 previously drawn by the intake tube 40 and used during the grinding (or fining, polishing) operation back into the slurry container 12. As such, when a lower surface of the housing 28 is placed on the inclined glass 26, with the level of slurry 44 tilted relative to a longitudinal axis X of the housing 28, a vacuum is established by action of the pump 16 and a continuous flow of slurry 20 circulates from the slurry container 12 into the housing 28 and back to the slurry container 12, as further described herein below. Once such a slurry circulation is established, the motor 36 is turned on and the lever 38 actuated to allow the polishing pad 30 to be pulled from or extended onto the glass 26, with the pad 30 momentarily holding the slurry 44 and forcing the latter against the glass 26 through an aperture (not shown). The tool 24 is then manually moved across the surface of the glass 26 to be repaired (with an axis of rotation X substantially normal to the surface) utilizing the slurry 44 to lap away a fine layer of the glass 26. Once the grinding (or fining, polishing) action has been completed, the motor 36 can be turned off, resulting in the slurry 44 being fully drained from the housing 12 back into the slurry container 12 and the tool 24 being subsequently lifted away from the surface glass 26 by actuation of the retraction lever 38.

Still referring to FIG. 4, in order to create the vacuum effect desired for operation of the tool 24, an inlet tube 50 and an outlet tube 52 are provided to connect the slurry container 12 to the pump 16. In particular, vacuum is created by slurry 20 being pumped from the slurry container 12 through tube 50 and expelled by the pump 16 back towards the slurry container 12 through a pressurized vessel, such as a venturi 54 or the like, mounted on the tube 52 well below the level of slurry 20. As will be apparent to a person skilled in the art, a vessel other than the venturi 54 may be used so long as an outlet opening (not shown) thereof is substantially smaller than the openings of the tubes 50, 52 connected to the container 12, thus achieving the desired vacuum effect. The venturi 54 illustratively provides a low pressure region in the center between converging and diverging portions thereof, thus creating vacuum when the pump 16 is in operation. The slurry 20 expelled through tube 52 into the slurry container 12 is then used to agitate the slurry 20 and maintain solids (not shown) in the slurry 20 forming the polishing compound in suspension, as desired to ensure proper abrasive effect of the slurry 20. The vacuum created by the venturi 54 in cooperation with the pump 16 is further propagated to the tool 24 (to circulate slurry 20 therethrough) by acting on a tube 56 having a first end mounted to the low pressure region of the venturi 54 and a second end attached to a "Y" fitting 58.

Still referring to FIG. 4, the Y fitting 58 is in turn connected to the vacuum and draw tube 46 as well as to another tube 60, which is illustratively attached from underneath the container lid (reference 18 in FIG. 2) to the vacuum gauge 22 and the vacuum bleed valve 62. In this manner, the slurry 20 is only pumped from the slurry container 12 through the tube 40 when the vacuum bleed valve 62 is in the closed position, thus ensuring maximum pressure through the tube 40. In particular, the amount of vacuum being drawn (and accordingly the flow of slurry 20) as well as the force holding the lower surface of the housing 28 against the glass can illustratively be regulated by opening the vacuum bleed valve 62 and adjusting an opening of the latter to vary the level of vacuum pressure. The vacuum created at the venturi 54 thus creates a vacuum in the intake tube 40 to draw the slurry 20 into the housing 28 in a conventional manner. A quantity of slurry 44 accumulates into the housing 28 and is subsequently removed therefrom into the venturi 54 and discharged (along with the slurry discharge from the pump 16) back into the slurry container 12. As the slurry 44 is pulled through the vacuum and draw tube 46, vacuum is further created in the housing 28 due to the action of the seal 32, thus promoting circulation of the slurry 20 and maintaining a constant supply of slurry 44 in the interior of the housing 28 to keep the tool 24 in operation.

Still referring to FIG. 4, the adapter 42 illustratively comprises three (3) Allen screw locks including two (2) rubber washers (none shown) applied to the drive shaft (not shown) mounted within the housing tube 34 for driving the polishing pad 30. In this manner, an increase of vacuum pressure of an extra four (4) inches can be achieved on the mercury gauge 22 due to reduced losses. Thus, the adapter 42 allows to overcome the problem of conventional prior art systems, in which a constant loss of pressure within the tool 24 is typically incurred due to leakage at the connection between the slurry intake tube as in 40 and the tool 24 and eventually results in malfunctioning of the tool 24.

Figure 5A:
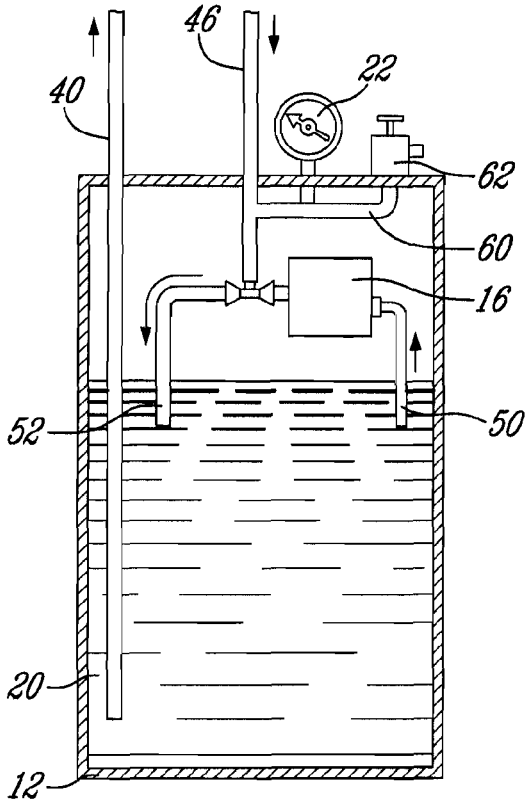
FIG. 5*a* is a sectional, part schematic view of a heatless slurry circulation system in accordance with an alternative illustrative embodiment of the present invention.
Figure 5B:
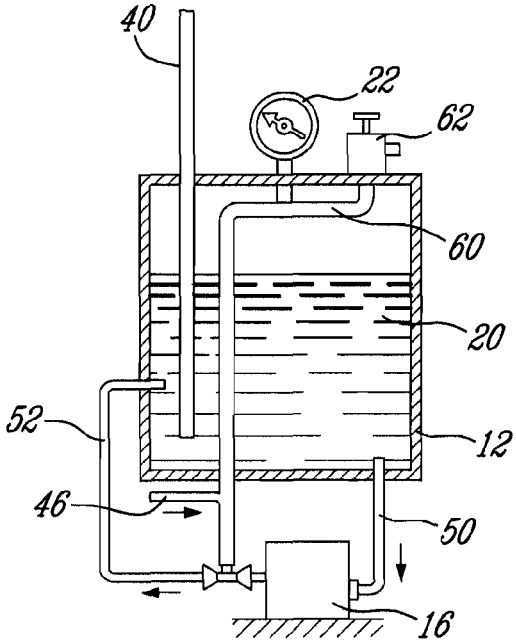
FIG. 5*b* is a sectional, part schematic view of a heatless slurry circulation system in accordance with a further alternative illustrative embodiment of the present invention.
Figure 5C:
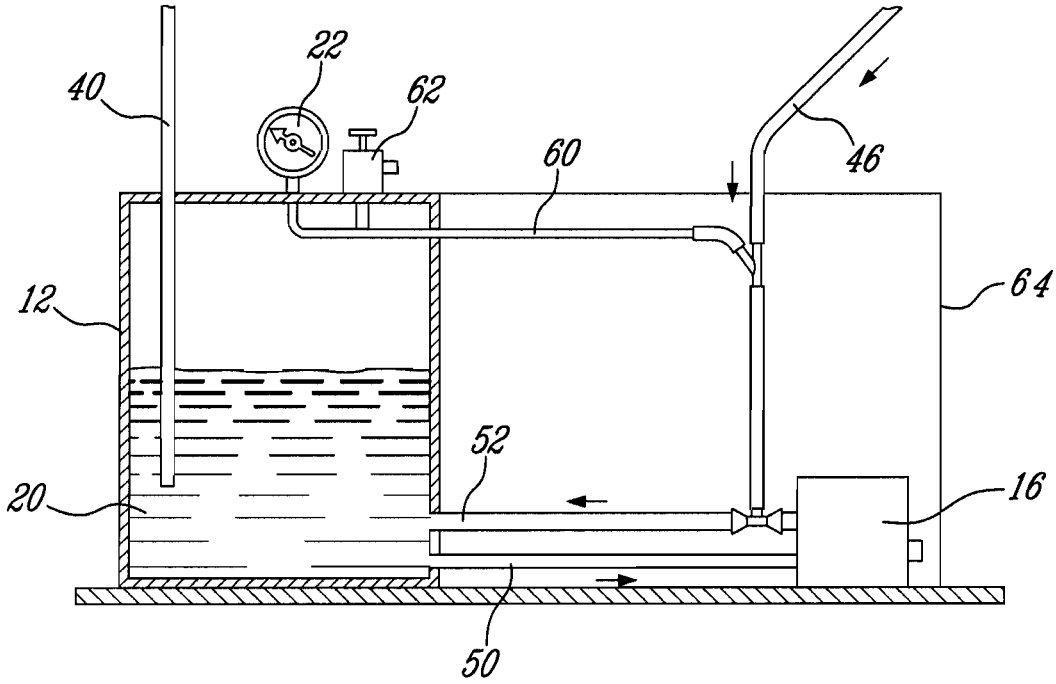
FIG. 5*c* is a sectional, part schematic view of a heatless slurry circulation system in accordance with yet a further alternative illustrative embodiment of the present invention.

Referring now to FIG. 5*a*, FIG. 5*b*, and FIG. 5*c*, according to alternative embodiments of the present invention, the pump 16 may be placed at different positions relative to the slurry container 12, as long as the pump 16 is isolated from the slurry 20. For example, instead of being positioned to a side of the slurry container 12 as illustrated in FIG. 4, the pump 16 may be suspended inside the slurry container 12 above the surface of the slurry 20 (see FIG. 5*a*). Alternatively, the pump 16 may be positioned externally underneath the slurry container 12 (see FIG. 5*b*). Also, the pump may be shelled away from the slurry container 12 within an outer container 64, which illustratively holds the slurry container 12 therewithin, so that the pump 16 is isolated from the slurry 20 by the outer surface of the inner slurry container 12 (see FIG. 5*c*).

Referring back to FIG. 1, the pump 16 is illustratively a dual purpose oil-filled pump (e.g. of the Little Giant® model) having a rating of 525 Gallons per hour (GPH) for a slurry container 12 of between two (2) and 60 gallons. With such a rating, maximum vacuum circulation can be achieved throughout the entire system 10 with stable average rate readings measured on the gauge 22 from about 17 inches of mercury up to 20 inches. Such a pump 16 could be used with a slurry intake tube 40 of up to 50 feet. The size (i.e. the ratings) of the pump 16 is selected in consideration with the size of the slurry container 12: for a larger slurry container 12, it is desirable to use a more powerful pump 16 capable of carrying a higher vacuum pressure.

Still referring to FIG. 1, the heatless slurry system 10 may also be used with two (2) pumps as in 16. In this case, the elements of the system 10 are doubled except for the container 12, the water tank 14 and the fining/grinding/polishing tool (reference 24 in FIG. 4). The second pump as in 16 would be connected via a splitter (not shown) to the existing slurry container 12 and water tank 14 and would enable a higher vacuum pressure (e.g. up to 23 inches of mercury on the gauge, reference 22 in FIG. 4) to be achieved. With two (2) pumps as in 16 connected in this manner, it then becomes possible to achieve such pressure readings using a slurry intake tube (reference 40 in FIG. 4) having a length up to about 100 feet to connect the tool 24 to the pump 16 and slurry container 12. Additional pumps as in 16 may further be added to a single slurry container 12 containing up to 60 gallons of slurry (reference 20 in FIG. 4) in order to increase the vacuum pressure within the slurry container 12 up to a desired level, thus improving the performance of tool 24 and as such that of the overall system 10, including additional operational modules, while still providing adequate manageability to the operator or operators. In particular, using additional pumps as in 16 enables a plurality of operators to each connect a tool 24 to a single slurry container 12, thus allowing a plurality of operators to perform fining/polishing/grinding work at once.

Still referring to FIG. 1, in addition to decreasing costs due to the simplicity of the design, the heatless slurry system according to the present invention is advantageously more efficient than prior art slurry systems. Indeed, the system 10 improves agitation of the slurry 20 by ensuring an even flow in the slurry container 12 while at the same time achieving a stable vacuum pressure therewithin. More importantly, positioning the pump 16 externally with respect to the slurry container 12 overcomes most of the heating problem associated with conventional slurry systems. Indeed, in known systems, the heat produced by the working pump as in 16 is transferred to the slurry (reference 20 in FIG. 4) since the pump 16 is typically submerged into the slurry container 12. However, when the slurry 20 reaches a certain temperature, it loses its ability to remove scratches and the use of the tool (reference 24 in FIG. 4) must be stopped to replace the slurry 20. It is therefore desirable to evacuate the heat produced by the operating pump 16. Indeed, it has been discovered by the present inventors that such heat represents the major part (e.g. 80%) of the heat problem faced by conventional slurry systems. Accordingly, the external location of the pump 16 advantageously enables the heat produced by the pump 16 to be evacuated in the air. Alternatively, the pump 16 may be removed or isolated or insulated from the abrasive solution 20 to achieve thermal isolation. As a result, an overheating of the abrasive polishing solution or slurry 20 is prevented and a less frequent change of the slurry 20 is required, thus decreasing the total amount of slurry 20 necessary. Therefore, when a larger area (reference 26 in FIG. 4) needs restoring, less space is required to transport the slurry 20 onto the working site. Also, the restoration work becomes more efficient since the polishing or fining tool 24 can be used without interruption.

It should be noted that another way of reducing the heat in the slurry container 12 would be increase its size or volume. However, this poses transportation problems as the system would be too large to easily transport.

Advantageously, during operation of a system 10 according to a preferred embodiment of the present invention, the abrasive slurry solution 20 is returned back into the container 12 and agitates the abrasive slurry solution 20 within said container 12. This is particularly useful as this avoids the need to use of a separate agitator.

Although the present invention has been described hereinabove by way of specific embodiments thereof, it can be modified, without departing from the spirit and nature of the subject invention as defined in the appended claims.

The invention claimed is:

1. A heatless slurry system for restoring a surface comprising:

a container containing an abrasive slurry solution;

a tool adapted to be moved across the surface for restoration thereof, said tool comprising a housing having mounted thereto a first connection line in fluid communication with said container for drawing said abrasive slurry solution into said housing and a second connection line for removing said drawn abrasive slurry solution from said housing; and a pump comprising an inlet and an outlet connected to said container for providing fluid communication therewith, said outlet comprising a pressurized vessel for creating a vacuum pressure as said abrasive slurry solution is pumped from said container through said inlet and expelled through said outlet, said pressurized vessel connected to said second connection line;

wherein said vacuum pressure draws said abrasive slurry solution into said housing via said first connection line and subsequently removes said drawn abrasive slurry solution from said housing via said second connection line, thereby creating a flow of said abrasive slurry solution within said housing for restoring the surface; and further wherein a surface of said pump is removed from said abrasive slurry solution for thermally isolating said pump therefrom, thereby preventing a rise in a temperature of said abrasive slurry solution as a result of operation of said pump.

2. The system of claim 1, wherein said abrasive slurry solution comprises particles in suspension and further wherein said removed abrasive slurry solution is returned back into said container for agitating said abrasive slurry solution within said container.

3. The system of claim 1, wherein said vacuum pressure further urges a lower surface of said tool substantially flush against said surface.

4. The system of claim 3, wherein said urged tool is moved across the surface with an axis of rotation substantially normal to the surface.

5. The system of claim 1, further comprising a peripheral seal mounted around a perimeter of said housing for sealing said tool against the surface.

6. The system of claim 1, wherein said tool is for fining the surface.

7. The system of claim 1, wherein said tool is for grinding the surface.

8. The system of claim 1, wherein said tool is for polishing the surface.

9. The system of claim 8, wherein said tool comprises a polishing pad and a retraction lever pivotally attached to said housing for alternatively pulling said polishing pad from and extending said polishing pad onto the surface.

10. The system of claim 1, further comprising a vacuum bleed valve for adjusting the amount of vacuum created by said pressurized vessel.

11. The system of claim 10, wherein said abrasive slurry solution is pumped through said inlet and expelled through said outlet when said vacuum bleed valve is in a closed position.

12. The system of claim 11, wherein said amount of vacuum created by said pressurized vessel is adjusted by moving said vacuum bleed valve between a plurality of opened positions.

13. The system of claim 1, wherein said pressurized vessel is a venturi.

14. The system of claim 1, further comprising an adapter at a connection between said first connection line and said housing for preventing losses in said vacuum pressure at said connection.

15. The system of claim 1, further comprising a water tank containing water to be used as a lubrication means between said tool and the surface for easing displacement of said tool on the surface.

16. The system of claim 1, wherein said pump is suspended inside said container above a surface of said abrasive slurry solution.

17. The system of claim 1, wherein said pump is mounted externally to a side of said container.

18. The system of claim 1, wherein said pump is mounted externally underneath said container.

19. The system of claim 1, wherein said pump is shelled away from said container within an outer container, wherein said outer container holds said container and said shelled pump therewithin.

20. The system of claim 1, further comprising an additional pump connected to said pump via a splitter to increase said vacuum pressure.

* * * * *